US010759032B2

(12) United States Patent
Schmidt et al.

(10) Patent No.: US 10,759,032 B2
(45) Date of Patent: Sep. 1, 2020

(54) FUEL GAS-OPERATED DRIVE-IN DEVICE HAVING VALVE COMPONENT

(71) Applicant: Hilti Aktiengesellschaft, Schaan (LI)

(72) Inventors: Dominik Schmidt, Buchs (CH); Tilo Dittrich, Feldkirch (AT); Peter Bruggmueller, Bludesch (AT); Norbert Heeb, Buchs (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 123 days.

(21) Appl. No.: 15/752,999

(22) PCT Filed: Sep. 6, 2016

(86) PCT No.: PCT/EP2016/070938

§ 371 (c)(1),
(2) Date: Feb. 15, 2018

(87) PCT Pub. No.: WO2017/045971

PCT Pub. Date: Mar. 23, 2017

(65) Prior Publication Data

US 2019/0001474 A1 Jan. 3, 2019

(30) Foreign Application Priority Data

Sep. 14, 2015 (EP) ..... 15185079

(51) Int. Cl.
*B25C 1/08* (2006.01)
*B25C 1/00* (2006.01)

(52) U.S. Cl.
CPC ..... *B25C 1/08* (2013.01); *B25C 1/008* (2013.01)

(58) Field of Classification Search
CPC ..... B25C 1/08; B25C 1/008
(Continued)

(56) References Cited

U.S. PATENT DOCUMENTS 5,873,508 A 2/1999 MacVicar et al.
6,334,495 B2 * 1/2002 Deimel ..... B25D 9/14 173/115
(Continued)

FOREIGN PATENT DOCUMENTS

CN 101035654 A 9/2007
CN 101687314 A 3/2010
(Continued)

OTHER PUBLICATIONS

International Bureau, International Search Report in International Application No. PCT/EP2016/070938, dated Nov. 14, 2016.

*Primary Examiner* — Michelle Lopez
(74) *Attorney, Agent, or Firm* — Leydig Voit & Mayer, Ltd.

(57) ABSTRACT

The invention relates to a drive-in device comprising a drive-in piston guided in a cylinder for driving a nail component into a work piece, a combustion chamber arranged on the drive-in piston, and which can be filled with an incendive gas mixture, a charge component for producing an over-pressure of the gas mixture, and a touch component for recognising a pressing of the drive-in device on a work piece, wherein the combustion chamber is connected to an outer space via a valve component, wherein the valve component is controlled in accordance with a position of the touch component, such that, in the event of a non-ignition, the over-pressure of the gas mixture can escape via the valve component after a removal of the drive-in device.

20 Claims, 3 Drawing Sheets

(58) Field of Classification Search
USPC ..... 227/8, 10
See application file for complete search history.

(56) References Cited

U.S. PATENT DOCUMENTS

| | | | | |
|---|---|---|---|---|
| 7,721,927 | B2 | 5/2010 | Osuga | |
| 8,091,751 | B2 | 1/2012 | Tanaka | |
| 8,336,749 | B2 | 12/2012 | Largo | |
| 8,561,869 | B2 * | 10/2013 | Towfighi | B25C 1/06 227/10 |
| 8,602,283 | B2 | 12/2013 | Tamura et al. | |
| 2004/0134960 | A1 * | 7/2004 | Schiestl | B25C 1/08 227/10 |
| 2004/0134961 | A1 * | 7/2004 | Wolf | B25C 1/08 227/10 |
| 2005/0001002 | A1 | 1/2005 | Schiestl et al. | |
| 2006/0054116 | A1 | 3/2006 | Schiestl et al. | |
| 2009/0250499 | A1 * | 10/2009 | Hahn | B25C 1/08 227/10 |
| 2016/0144497 | A1 | 5/2016 | Boehm et al. | |

FOREIGN PATENT DOCUMENTS

| | | | |
|---|---|---|---|
| CN | 102361727 | A | 2/2012 |
| DE | 3904504 | A1 | 3/1990 |
| DE | 102004043955 | A1 | 3/2006 |
| EP | 2826601 | A1 | 1/2015 |
| WO | WO 2007/048006 | A2 | 4/2007 |
| WO | WO 2009/140728 | A1 | 11/2009 |
| WO | WO 2012/046217 | A1 | 4/2012 |

* cited by examiner

FUEL GAS-OPERATED DRIVE-IN DEVICE HAVING VALVE COMPONENT

CROSS-REFERENCE TO RELATED APPLICATIONS

This patent application is the U.S. National Stage of International Patent Application No. PCT/EP2016/070938, filed Sep. 6, 2016, which claims the benefit of European Patent Application No. 15185079.9, filed Sep. 14, 2015, which are each incorporated by reference.

The invention relates to a nail gun, in particular a manually controlled nail gun according to the preamble of claim 1.

BACKGROUND OF THE INVENTION

WO 2009/140728 A1 describes a combustible gas operated nail gun for driving nails into a workpiece, in which a combustion chamber is charged with a combustible gas, wherein after an ignition process, a driving piston is accelerated against the nail. The combustible gas can be charged by combined measures by means of a fan or the stroke of the driving piston against a positive pressure, in order to increase the driving energy.

U.S. Pat. No. 8,091,751 B2 describes a combustible gas operated nail gun in which the combustible gas can be charged by means of an electric compression against a positive pressure. A combustion chamber of the device comprises several combustion chamber portions that are movable toward one another and is closed by means of a compression rod when the nail gun is pushed against a workpiece.

BRIEF SUMMARY OF THE INVENTION

It is the problem of the invention to provide a nail gun that has high operational reliability.

This problem is solved for the initially mentioned nail gun with the characterizing features of claim 1. By provision of the valve element, a combustion chamber that is charged and under a positive pressure can be emptied in a controlled and safe manner if there is no ignition.

Generally preferably, the valve element opens automatically when the nail gun is removed from the workpiece.

The absence of ignition of the mix can have any number of causes, for example deliberate interruption of the setting process by the operator, or even some sort of operational breakdown.

A positive pressure of the combustible gas mix in the sense of the invention means a pressure that is increased using a charging element to raise the driving energy. Also with conventional devices, the pressure of the combustible gas mix usually is somewhat above an ambient pressure, as the combustible gas under pressure is added to the air in the combustion chamber which is under atmospheric pressure. This is only a slight pressure increase. A positive pressure in the sense of the invention preferably is around at least 100 mbar, especially preferably around at least 20 mbar above atmospheric pressure.

A charging element in the sense of the invention can be any means that at least raises the air portion of the combustible gas mix above the atmospheric pressure. In particular this can be an electrical compressor.

A valve element in the sense of the invention controllably blocks or opens a connection between the combustion chamber and an outer space. In the sense of the invention, the valve element is not understood to be a movable combustion chamber part, the movement of which first forms the combustion chamber.

A sensor element in the sense of the invention is understood to be any mechanical, electromechanical, optoelectronic, or other component by means of which a compressed state of the nail gun may be determined. For example, the sensor element can be a moving rod, an electrical switch, an optical sensor, etc.

According to the invention, the sensor element is connected to the valve element in such a way that the valve element is controlled depending on a position of the sensor element. In the case of ignition failure of the gas mix, removal of the nail gun can be determined from the sensor element, and the combustible gas mix under positive pressure can escape via the valve element.

In a generally advantageous embodiment of the invention, the combustion chamber comprises at least combustion chamber parts movable with respect to one another, wherein the combustion chamber parts are combined into the closed combustion chamber only when the nail gun is in a compressed state. Devices of such design are generally known and due to their construction are quite safe with respect to inadvertent or improper triggering. Although, during charging of such conventional devices with positive pressure, it has been shown that automatic opening or even collapse of the combustion chamber can be disrupted when the device is removed when no ignition occurs. This is basically because such a combustion chamber has large sealing surfaces and sealing systems, on which the correspondingly strong forces act due to the positive pressure. Solutions in which a stronger spring force of a return spring is provided corresponding to the positive pressure are uncomfortable because of the necessary greater pressing force by the operator. The additional valve element according to the invention allows a largely conventional design of the combustion chamber, as the positive pressure initially is reduced in a targeted manner, after which opening or collapsing of the combustion chamber occurs with low spring forces.

In an especially preferred embodiment it is provided that the combustion chamber parts are closed gas-tight in the closed state by means of a self-reinforcing sealing system. With such a system, the compression forces of the seals rise with the pressure in the combustion chamber, so that a maximal positive pressure in principle can be arbitrary and can be selected independently of the force of a compression spring or the like.

For a preferred detailed design of the invention, the combustion chamber parts are moved toward each other via a compression rod, wherein the sensor element is additionally provided for the compression rod. This allows reliable control of the valve element when the nail gun is removed regardless of the selected positive pressure and its effect on the compression rod. For other embodiments, however, the valve element can also be controlled directly by the compression rod.

Generally advantageously it is provided that the valve element is designed to be low-power with respect to the positive pressure. Preferably this is achieved simply in that a valve rod of the valve element has a direction of motion that runs transversely to a direction of action of the positive pressure of the gas mixture. A low-power design is herein understood to be any valve arrangement in which a normal operating positive pressure alters a necessary actuating force of the valve element at most insignificantly.

In a first possible embodiment, the valve element is connected mechanically directly to the sensor element, so that a movement of the sensor element effects an adjustment of the valve. This allows a simple implementation and great reliability against operating disruptions, for example of control electronics.

In a second possible embodiment, the valve element can be adjustable via an electrical actuator. Preferably the actuator in this case is connected to an electronic control unit of the nail gun. With this embodiment, the sensor element can be configured as an electrical switch or sensor, by which construction weight is generally saved. In addition, such a solution permits a universal control of the valve element as a safety means.

In a structurally simple and generally preferred embodiment of the invention, the charging element comprises an electrical compressor. Alternatively, the charging element can also be a manually actuated compressor, a compressed air reservoir, or the like. Preferably the charging element is integrated into the setting device. Alternatively, the charging element can be separate from the usual setting device.

In a generally advantageous further development of the invention, the gas mix escaping via the valve element drives a generator in order to partially convert mechanical pressure energy into electrical energy. The mechanical energy of the charged gas therefore is not completely lost when a setting process is interrupted, but can in part be returned to a battery of the device. In a preferred further development, the generator is configured by changing the operating mode of the charging element. In this way additional structural components can be saved.

Further advantages and features of the invention follow from the exemplary embodiments described below, as well as from the dependent claims.

BRIEF DESCRIPTION OF THE SEVERAL VIEWS OF THE DRAWING(S)

Below two preferred exemplary embodiments of the invention are described and explained in more detail with reference to the attached drawings.

DETAILED DESCRIPTION OF THE INVENTION

Figure 1:
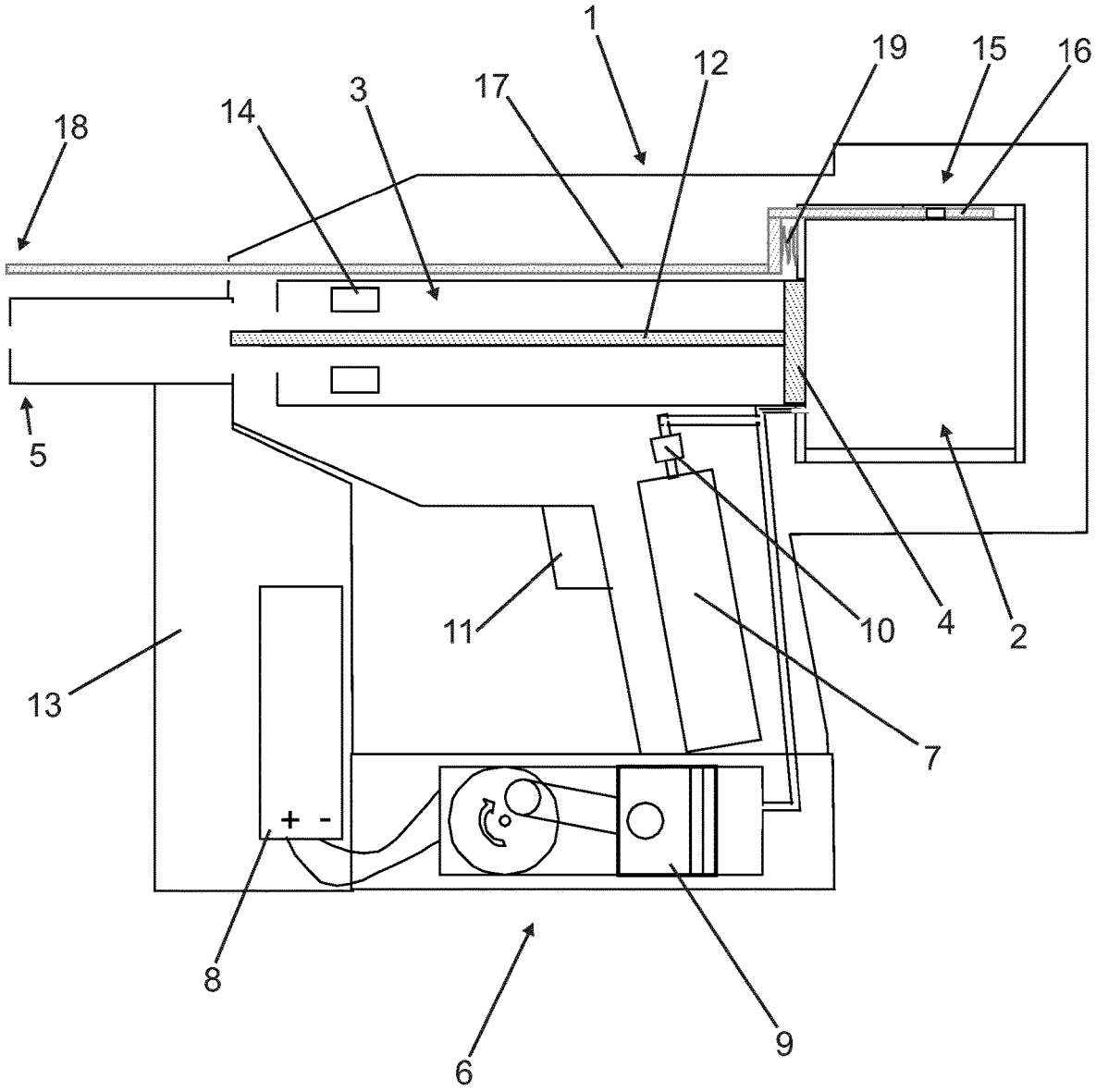
FIG. 1 shows a schematic sectional view of a nail gun according to the invention of a first exemplary embodiment with mechanically controlled valve element in a first operating state.

The nail gun from FIG. 1 is a manually controlled device comprising a housing 1 and a combustion chamber 2 accommodated therein and having a combustion chamber wall. A cylinder 3 abuts the combustion chamber 2 with a driving piston 4 guided therein.

A safety mechanism of the device comprises a compression rod with mounting sleeve 5, which is mounted on a workpiece (not shown) and is pushed against the pressure of a spring (not shown). Only in this state can a driving process be triggered by ignition of a combustible gas in the combustion chamber 2. The combustion chamber 2 consists of several combustion chamber parts (not shown) that are movable toward one another, which only after pressing of the mounting sleeve 5 via the compression rod are combined into a closed space for receiving an ignitable combustible gas mix. Such designs of combustion chambers with the purpose of safety improvement are generally known, for example from the above-named publications. A detailed representation of these safety mechanisms in the present schematic drawings was therefore dispensed with.

An ignitable combustible gas mix is presently fed by means of a charging element 6 and a combustible gas container 7 into the combustion chamber 2. The charging element 6 is configured as an electrical compressor 9 supplied by a battery 8. The combustible gas is fed via a dispensing valve 10 from the combustible gas container to the compressed air downstream of the compressor 9, after which the flow of the combustible gas mix enters the combustion chamber 2 via a supply line.

When the combustion chamber is charged, ignition of the combustible gas mix can be actuated via a manually activated trigger 11, so that the driving piston 4 is driven forward and via a driving member 12, a nail element (not shown) is driven into the workpiece. The exhaust gases of the ignited and expanded combustible gas can exit to the external space via outlet openings 14 at the end of the path of the driving piston.

A return of the driving piston 4 after the driving process occurs in the conventional way, for example by means of a return spring.

In the present examination, the combustion chamber parts in mounted state of the device are sealed by means of a sealing system such that a pressure increase in the combustion chamber 2 leads to an increase in the forces acting on the seals (self-reinforcing sealing system). The result is that when the setting process does not take place and the nail gun is removed, the combustion chamber remains in the charged state.

To reduce the positive pressure in the combustion chamber, according to the invention a valve element 15 is provided that connects the combustion chamber 2 to the external spaced. The valve element 15 has a valve slide 16, which moves transversely to the pressure direction or the outflow direction of the combustible gas mix. In this way a resistance of the valve slide is scarcely dependent on the amount of positive pressure in the combustion chamber 2.

The valve slide 16 is connected via a mechanical rod 17 to a sensor element 18. The sensor element 18 is in the region of the mounting sleeve 5 and is shown in the schematic drawing as a depressible probe tip.

Figure 2:
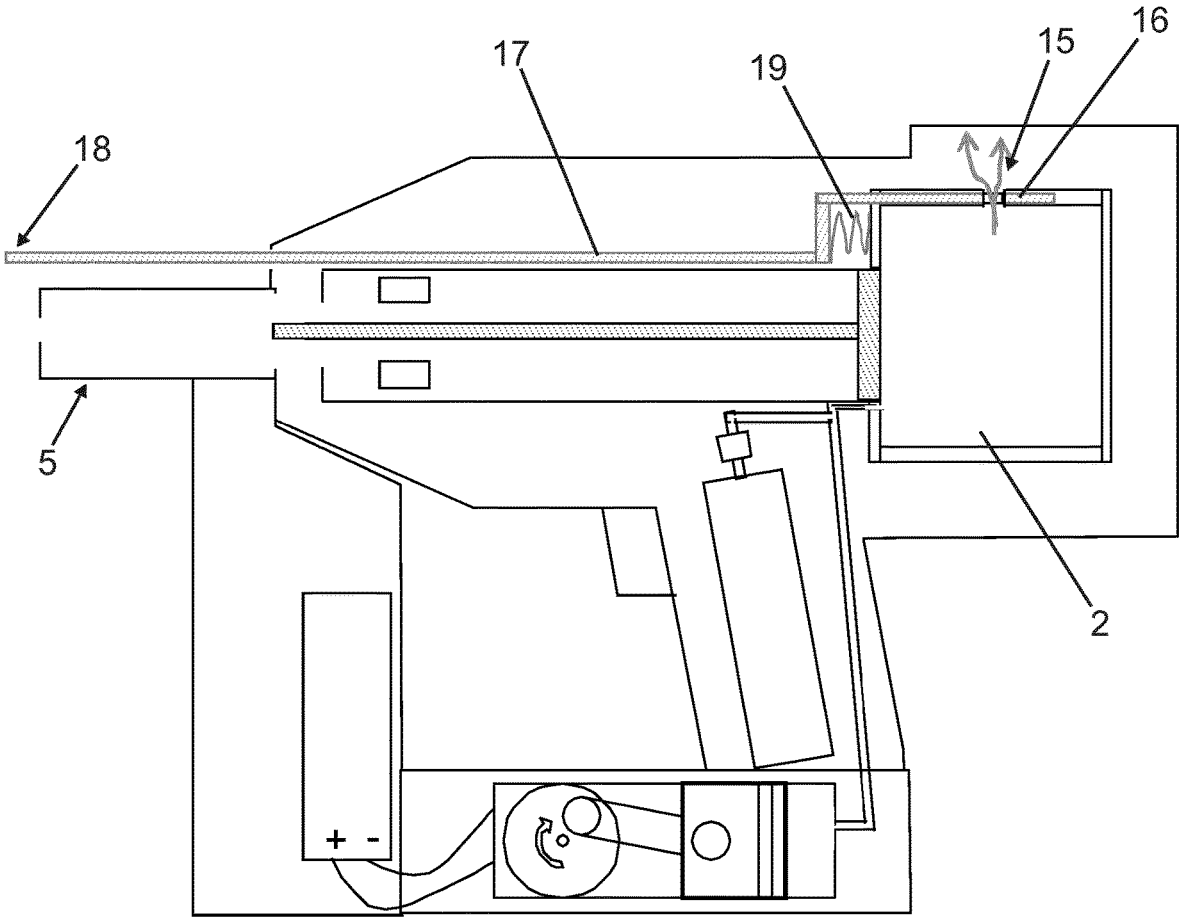
FIG. 2 shows the nail gun of FIG. 1 in a second operating state.

The rod 17 is acted on by the force of a spring 19, so that the sensor element 18 is driven forward when the nail gun is in unmounted state, and the valve element 15 is in an opened state (see FIG. 2).

When the nail gun is mounted on the workpiece, the sensor element 18 is pushed against the spring pressure. The valve slide 16 is hereby displaced by the rod 17 and the valve element 15 is closed. The valve function is shown in the drawings by the covering or displaced openings in the valve slide 16 and in the combustion chamber wall.

For the mounted status of the nail gun shown in FIG. 1, the combustion chamber 2 with the combustible gas mix is acted on by the positive pressure. The mounting sleeve 5 and sensor element 18 are pushed inward.

If the device is now removed from the workpiece without triggering, the mounting sleeve 5 initially remains in its position, as the combustion chamber parts cannot be displaced. The sensor element 18 on the other hand, based on the spring force of the spring 19, moves forward, so that the valve element 15 is opened via the rod 17. In this way the combustible gas mix can escape and the positive pressure in the combustion chamber 2 can be reduced (intermediate status according to FIG. 2).

After a reduction of the positive pressure, the combustion chamber parts can be moved by engaging spring forces, so that the mounting sleeve is also returned to the forward position (not shown).

It is understood that the valve element according to the invention then also represents an advantageously further development and a gain in safety when the sealing system of the combustion chamber is not designed as self-reinforcing or when the return spring force of the combustion chamber parts are also designed for opening under positive pressure. An operating fault in connection with a charged combustion chamber can thus be reliably avoided.

Figure 3:
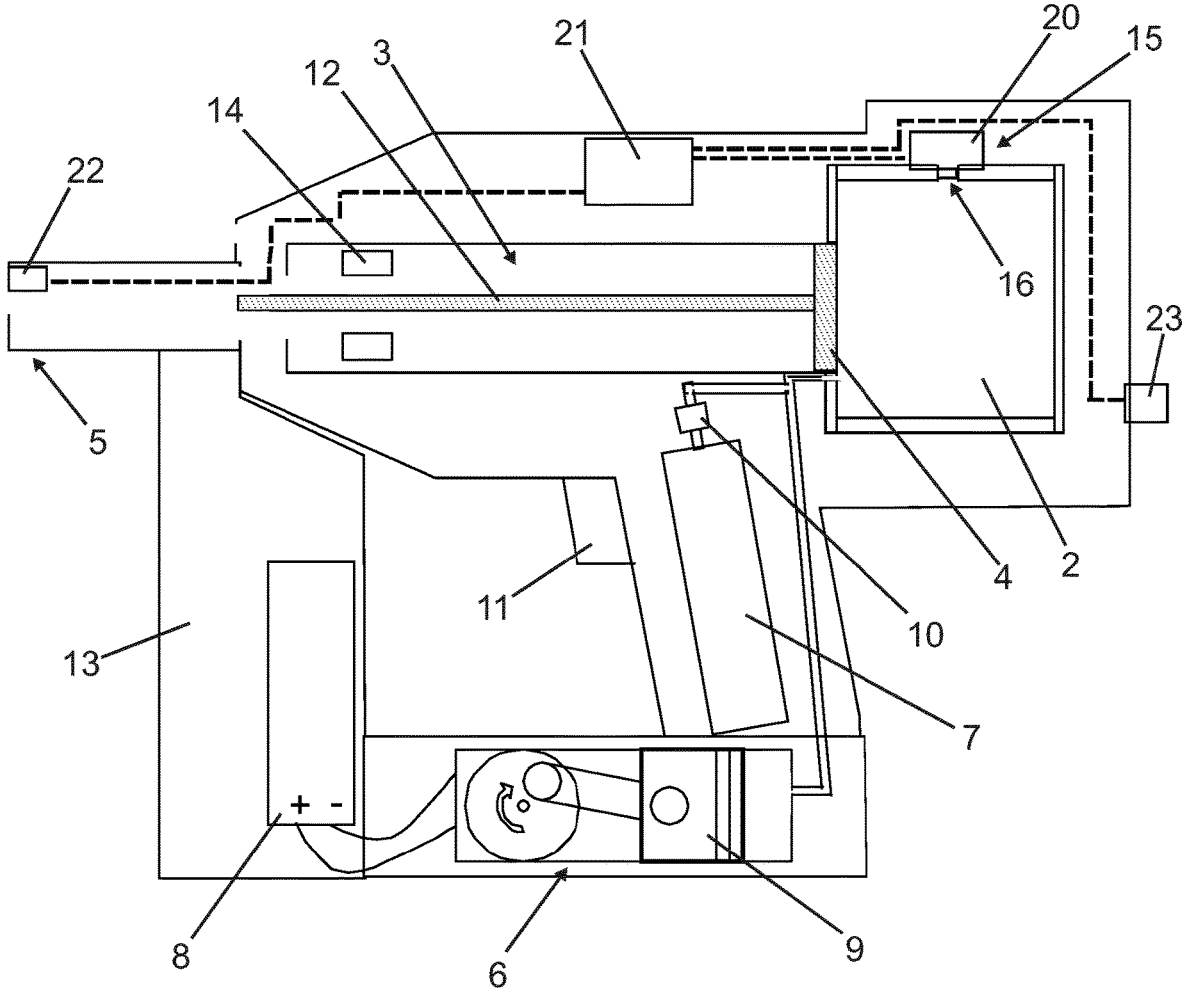
FIG. 3 shows a schematic sectional view of a nail gun according to the invention of a second exemplary embodiment with electrically controlled valve element.

FIG. 3 shows a second exemplary embodiment of the invention in which, in contrast to the first exemplary embodiment, the valve element 15 is electrically actuated.

Toward this end the valve element 15 has an electrical actuator 20, which is connected to an electronic control unit 21. The sensor element is configured as an electrical sensor element 22 on the end of the mounting sleeve 5. The sensor element 22 is likewise connected to the control unit 21.

As a further embodiment, the nail gun has a manually operated switch 23, which is readily reachable on the housing 1 of the nail gun.

A valve element so designed can be configured for example as currentless open so as to ensure a maximum of safety. Opening of the closed valve element of the present example occurs in operation when the sensor element 22 is not seated on a workpiece. But opening also occurs when the manually operated switch 23 is pushed. In this way, the operator can discharge the combustion chamber at any time, or ensure the discharged state of the device.

The invention claimed is:

1. A nail gun for driving a nail element into a workpiece comprising a driving piston guided in a cylinder;

a combustion chamber which is arranged on the driving piston and may be filled with an ignitable gas mix;

a charging element for achieving a positive pressure of the ignitable gas mix; and a sensor element for identifying pressure of the nail gun on a workpiece;

wherein the combustion chamber is connected with an exterior space via a valve element, wherein the valve element is controlled depending on a position of the sensor element, so that if the ignitable gas mix is not ignited, the positive pressure of the ignitable gas mix can escape via the valve element.

2. The nail gun according to claim 1 wherein the combustion chamber comprises at least two combustion chamber parts that can be moved toward each other, wherein the at least two combustion chamber parts are combined into the closed combustion chamber only when the nail gun is in a pressed status.

3. The nail gun according to claim 2, wherein the at least two combustion chamber parts are gas-tight closed in the closed state via a self-reinforcing sealing system.

4. The nail gun according to claim 3, wherein the at least two combustion chamber parts are moved toward one another via a compression rod, wherein the compression rod further comprises the sensor element.

5. The nail gun according to claim 3, wherein the valve element is configured to be low-power with respect to the positive pressure.

6. The nail gun according to claim 3, wherein the valve element is mechanically directly connected to the sensor element, so that a movement of the sensor element effects an adjustment of the valve element.

7. The nail gun according to claim 2, wherein the valve element is configured to be low-power with respect to the positive pressure.

8. The nail gun according to claim 2, wherein the at least two combustion chamber parts are moved toward one another via a compression rod, wherein the compression rod further comprises the sensor element.

9. The nail gun according to claim 8, wherein the valve element is configured to be low-power with respect to the positive pressure.

10. The nail gun according to claim 8, wherein the valve element is mechanically directly connected to the sensor element, so that a movement of the sensor element effects an adjustment of the valve element.

11. The nail gun according to claim 2, wherein the valve element is mechanically directly connected to the sensor element, so that a movement of the sensor element effects an adjustment of the valve element.

12. The nail gun according to claim 1, wherein the valve element is configured to be low-power with respect to the positive pressure.

13. The nail gun according to claim 12, wherein the valve element comprises a valve slide having a direction of motion running transversely to a direction of action of the positive pressure of the ignitable gas mix.

14. The nail gun according to claim 12, wherein the valve element is mechanically directly connected to the sensor element, so that a movement of the sensor element effects an adjustment of the valve element.

15. The nail gun according to claim 1, wherein the valve element is mechanically directly connected to the sensor element, so that a movement of the sensor element effects an adjustment of the valve element.

16. The nail gun according to claim 1, wherein the valve element may be adjusted via an electrical actuator.

17. The nail gun according to claim 16, wherein the electrical actuator is connected to an electronic control until of the nail gun.

18. The nail gun according to claim 1, wherein the charging element comprises an electrical compressor.

19. The nail gun according to claim 1, wherein the ignitable gas mix escaping via the valve element drives a generator so as to partially convert mechanical pressure energy into electrical energy.

20. The nail gun according to claim 19, wherein the generator is formed by a change in an operating mode of the charging element.

* * * * *